United States Patent [19]

Faudou et al.

[11] 4,225,051

[45] Sep. 30, 1980

[54] CONTAINERS FOR STORING FLUIDS UNDER PRESSURE

[75] Inventors: Jean-Yves Faudou, Orsay, France; Luc Delaey, Bertem; Dirk Van de Mosselaer, Niel, both of Belgium

[73] Assignee: L'Air Liquide, Societe Anonyme pour l'Etude et l'Exploitation des Procedes Georges Claude, Paris, France

[21] Appl. No.: 895,999

[22] Filed: Apr. 13, 1978

[30] Foreign Application Priority Data

Apr. 15, 1977 [FR] France ..... 77 11374

[51] Int. Cl.[3] ..... F17C 1/06

[52] U.S. Cl. ..... 220/3; 75/134 T; 75/154; 75/156.5; 75/159; 75/160; 75/161; 75/162; 75/165; 75/170; 75/173 R

[58] Field of Search ..... 220/3, 214; 428/626, 428/35, 416; 75/170, 173 R, 165, 153-162, 134 T

[56] References Cited

U.S. PATENT DOCUMENTS

| | | | |
|---|---|---|---|
| 3,446,393 | 5/1969 | Falkenai | 220/214 |
| 3,843,010 | 10/1974 | Morse et al. | 220/3 |
| 4,073,400 | 2/1978 | Brook et al. | 220/3 |

FOREIGN PATENT DOCUMENTS

| | | | |
|---|---|---|---|
| 2010841 | 9/1971 | Fed. Rep. of Germany | 428/614 |
| 7535070 | 6/1976 | France . | |
| 7513323 | 11/1976 | France . | |
| 1315653 | 5/1973 | United Kingdom . | |
| 1346046 | 2/1974 | United Kingdom . | |
| 1346047 | 2/1974 | United Kingdom . | |
| 1495259 | 12/1977 | United Kingdom . | |

*Primary Examiner*—L. Dewayne Rutledge
*Assistant Examiner*—Michael L. Lewis
*Attorney, Agent, or Firm*—Lee C. Robinson, Jr.

[57] ABSTRACT

This invention relates to lightweight containers for fluids under pressure.

The container is formed from an outer shell of fibrous material impregnated with resin and an inner wall made of an alloy which has a temperature $M_s$ for reversible martensitic transformation which is higher than or equal to the normal mean temperature at which the container is used.

The invention is applicable in particular to containers for storing and transporting gases at pressure higher than four bars.

8 Claims, 3 Drawing Figures

CONTAINERS FOR STORING FLUIDS UNDER PRESSURE

BACKGROUND OF THE INVENTION

The present invention relates to containers for storing fluids at a pressure higher than atmospheric pressure, of the kind comprising an outer shell which is formed by winding fibres of high specific mechanical strength impregnated with thermosetting resins and which resists the mechanical stresses set up by the fluids, and an inner wall of metallic material which forms an inner lining for the said shell and which provides a seal. Hereinafter, such containers will be referred to as "of the kind described".

Containers of the kind described are used for storing and transporting fluids of all kinds, be they liquid or gaseous and corrosive or non-corrosive at pressures which are generally high, that is to say greater than four bars. Their method of construction means that they are extremely light, which causes them to be preferred, in many applications, to containers made entirely of metal, whose dead weight is excessive.

The outer shell is made of a fibrous material, such as fibres of glass, polyamide, carbon, graphite, metal or boron, which are wound in circumferential or helical coils.

The object of the thermosetting resin with which the fibres are impregnated is to connect them together and it may be formed by a synthetic resin such as phenol-formaldehyde, polyester or epoxy resin. This shell, which forms a reinforcing structure to enable the containers to withstand the pressure of the fluid, is capable of withstanding an elastic deformation of 2 to 3% before fracture.

When the container is in use, the metal sealing wall, or liner, which is situated inside this shell is subjected to successive filling and emptying operations, that is to say to pressurisation and depressurisation cycles, and to the mechanical stresses which result. In certain present day containers, this wall is made of an aluminium alloy or of stainless steel. Although these metal walls, in contrast to thermo-plastics liners, have the advantage of being compatible with the majority of fluids, and in particular with oxygen, they are capable of withstanding only a very small amount of elastic deformation, i.e. less than 0.5%, that is to say an amount which is appreciably less than the outer shell can withstand. The inner wall is thus unable to follow deformation of the outer shell because it soon reaches the zone of plastic deformation. However, even when the shell is stressed to only a third of its breaking strength, the inner wall is already subject to excessive deformation which soon causes it to cold-flow and cracks to appear and finally the wall to fracture. In fact, the resistance which containers of the kind described have to stresses due to the periodic variations in pressure which occur during the pressurising and depressurising cycles thereof, is highly inadequate. In fact, their useful life does not generally exceed a thousand to two thousand such cycles.

Any increase in the thickness of the inner wall or the outer shell, with the object of restricting deformation, results in an increase in the weight of the container, which becomes as heavy as if it were made entirely of aluminium or steel.

Various solutions have been proposed to the problem of increasing the ability of the liner to deform.

One of these methods of manufacture, which is described in French patent application No. 2,137,976, consists in forming a layer to distribute the strain in the dome-shaped region of the container in order to reduce the area subject to high stress. In fact, containers constructed by this method soon show cracks and buckling in the region of the domes.

Another solution which is described in French patent specification No. 1,342,496, consists in providing a corrugated inner wall. Such a construction is expensive and does not substantially increase the useful life of the containers.

The disadvantages of the solutions proposed hitherto have led inventors to study more closely the knowledge so far acquired concerning the material forming the liner and the stresses which exist in this material.

It is known that many metallic materials, referred to as "super-elastic materials", have the characteristic of undergoing a transformation of the martensitic type which results in considerable changes in their physical properties.

This transformation may occur as a result of a change in the temperature of the material in the absence of mechanical stress, or as a result of mechanical stress exerted on the said material at a constant temperature. With certain metallic materials such as steels, when a martensitic transformation takes place at a constant temperature as a result of mechanical stress it is irreversible. With other materials on the other hand, this transformation of the martensitic type as a result of stress is reversible if the temperature at which the stress is exerted is suitably selected.

The temperature at which a structure of the martensitic type begins to appear, under no stress, when temperature decreases is generally referred to as the martensitic starting temperature $M_s$. The $M_s$ temperature thus constitutes a point of change in crystalline structure, the material passing from a phase which is stable at high temperature (the $\beta$ phase for many alloys) to the martensitic phase, which endows the material with a particular capacity for deforming elastically termed "super-elasticity". When stress (traction or compression) is exerted on the material, the temperature at which a phase of the martensitic type begins to appear alters and increases with the increase in the said stress.

The martensitic transformation which thus occurs under the prompting of stress results in the metallic material having a capacity for reversible extension of more than 1%, which leads to such materials being used to produce the inner walls of pressurised containers.

One object of the invention is to provide a satisfactory solution to the problem of elastic deformation of the inner wall of containers of the kind described, and provide containers whose useful life is longer than that of containers known hitherto.

SUMMARY OF THE INVENTION

The invention in a number of embodiments comprises a container of the kind described, wherein said inner wall is made of a metallic material which is capable of undergoing a change in crystalline structure of the martensitic type and whose temperature $M_s$ for the appearance of the martensitic phase on cooling is at least equal to the usual mean temperature at which the container is used. This temperature will hereinafter also be referred to as the operating temperature.

Thus, in accordance with the present invention, the temperature at which the container is normally used is a fundamental criterion for deciding the metallic material used to form the inner wall, this temperature representing the lower extreme at which the transformation point $M_s$ of the said material may be situated.

It should be noted that the metallic material according to the invention is already in the martensitic state at the mean operating temperature under zero tension and that it remains martensitic when it is subjected to stress since, when the stress increases, the temperature at which the martensitic phase starts increases likewise. This is a considerable advantage in comparison with materials whose $M_s$ temperature is below the mean operating temperature of the container since, in this latter case, the materials concerned only become martensitic when the level of stress is sufficiently high.

The inner wall of a container according to the invention is thus capable of deforming reversibly under mechanical stress and thus of following the deformations of the outer shell with no danger of cold-flow, cracks or fracture. There is thus no problem in subjecting containers provided with such walls to far more numerous cycles of pressurisation and depressurisation than containers known hitherto.

Furthermore, the fact that the material of the inner wall is martensitic at ordinary temperatures means that the said wall deforms elastically at low levels of stress and that the conditions in which it operates are thus optimum for it to resist corrosion.

In accordance with another feature of the invention, in the case of containers intended for use at a normal mean temperature of 20° C. the material may be an alloy whose $M_s$ temperature lies in the range between +20° and +50° C.

Alloys having an $M_s$ point in the aforesaid range are thus those which are suitable for producing containers used under the most common conditions, that is to say for the manufacture of the majority of containers for pressurised fluids. Experience shows that these alloys enable containers to be produced which are able to withstand more than 100,000 pressurisation/de-pressurisation cycles.

The invention also comprises a method of producing such a container for storing fluid under pressure.

With this method of obtaining a wall intended to form the inner lining of the outer shell, which wall is made of an alloy of predetermined composition and predetermined martensitic structure, the process starts with a part in the rough state such as an ingot, a sheet or a tube of the said alloy. The constituent parts of the said wall are produced by a shaping process, for example by rolling, roll-bending, hydrospinning, stamping or drawing; the said constituent parts are assembled, by welding for example, to produce the said wall, and the wall so produced is returned to the $\beta$ type domain and is then cooled rapidly so that the alloy has the aforesaid predetermined martensitic structure.

BRIEF DESCRIPTION OF THE DRAWINGS

Other objects, features and advantages of the invention will become apparent in the course of the following description read in conjunction with the accompanying drawings in which.

DETAILED DESCRIPTION OF PREFERRED EMBODIMENTS

Figure 1:
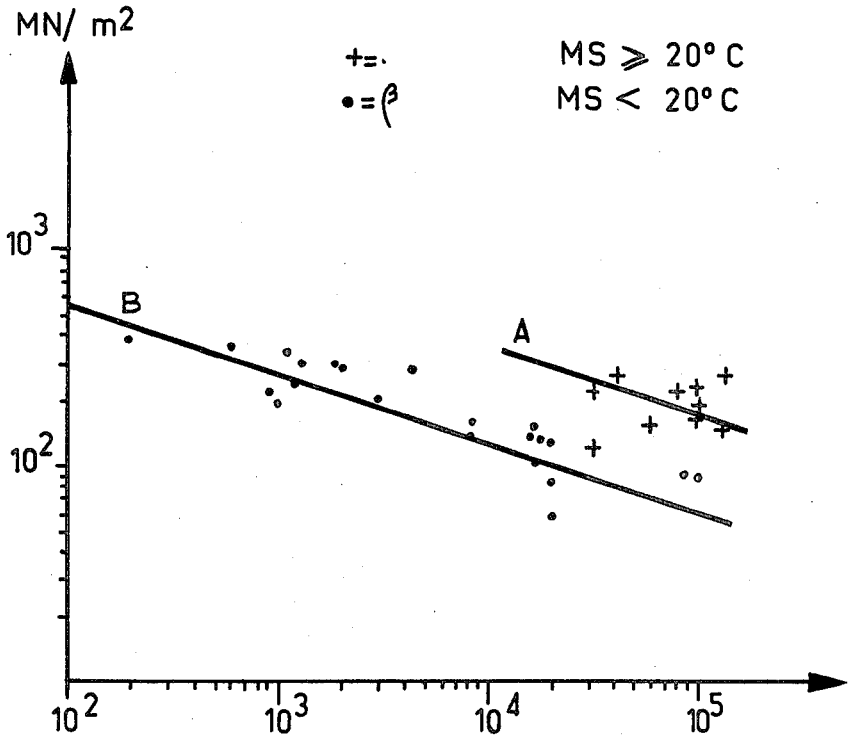
FIG. 1 shows fatigue curves for a material (B) of a known type and a material (A) according to the invention, as a function of stress.

Referring now to the drawings, the change in crystalline structure, or to be more exact the transformation of the martensitic type which occurs in certain metal alloys and which consists in the transition from a crystalline structure of the $\beta$ type to a crystalline structure of the martensitic type has been revealed by work done in the past. This is also true of the temperature $M_s$ which is characteristic of the start of the transformation. Thus, a special problem which has been posed for inventors has been to determine the preferential domain in which the $M_s$ temperature should be situated if the material is to have the maximum fatigue strength in the application envisaged, that is to say the formation of the inner walls of the containers normally intended for use between −20° C. and +50° C. For this purpose fatigue tests have been carried out consisting of repeated traction on test-pieces under ambient conditions and on metal discs subject to gas-pressure, the tests involving a large number of cycles in which the said test pieces and the said discs were subjected to an extension of approximately 1%. These tests were performed in particular on copper-zinc-aluminium alloys of different compositions which had different $M_s$ temperatures, some greater than or equal to 20° C. and others less than 20° C. The results obtained differ widely depending upon the $M_s$ temperature and the temperature at which the tests took place. These results are shown in the graph of FIG. 1, which shows the number of cycles (along the X axis) which the various alloys will withstand before fracture, as a function of the applied stress expressed in mega-Newtons per square meter (along the Y axis), at temperatures between −20° C. and +50° C. and with an extension greater than or equal to 0.6%. On the graph are shown the mean values (A) obtained with alloys having an $M_s$ temperature higher than or equal to +20° C. (and thus a martensitic structure at 20° C. and above) and the mean values (B) obtained with alloys having an $M_s$ temperature lower than +20° C. (and thus a $\beta$ structure at +20° C. and below).

Alloys having an $M_s$ temperature lower than the usual operating temperature (+20° C.) exhibit reversible behaviour from the first cycle, but the number of cycles which can be performed before fracture is always small and virtually never exceeds 20,000 cycles for an extension of 0.6%. It was found that the number of cycles achieved was larger, on average, when the temperature at which the test took place was low (−10° to 0° C.) than when it was higher (20° C. to 40° C.), but that alloys whose $M_s$ temperature is lower than the operating temperature of the container are unsuitable for producing containers having good fatigue strength.

In the case of alloys having an $M_s$ temperature higher than the usual operating temperature of +20° C., a residual elongation was found at the end of the first cycle after the stress had been relaxed. When the succeeding cycles were performed starting from the new dimension so obtained, for the test piece, reversible cycles were achieved and it was possible to perform more than 100,000 cycles without fracture on large numbers of samples with extensions equal to or greater than 0.6%.

These results pointed to the conclusion that alloys having a $M_s$ temperature higher than the usual operating temperature of containers for pressurised fluids, termed "martensitic alloys", are those which should be selected to produce containers of this kind which have a maximum useful life.

For a container which will usually be used at +20° C., the $M_s$ temperature of the alloy should be higher than +20° C. and preferably between +20° C. and +50° C.

For a container which is normally to be used at a temperature lower or higher than +20° C., it would be necessary to use an alloy whose $M_s$ temperature was respectively lower or higher than +20° C.

Another advantage of martensitic alloys is their resistance to corrosion under tension. It is in fact known that metallic materials which have good mechanical characteristics become more susceptible to corrosion when stress is applied to them and do so to a greater degree the greater the stress applied. "Martensitic alloys" deform elastically at very low levels of stress and thus resist corrosion well.

Among materials whose martensitic transformation is such that the $M_s$ point may be higher than +20° C., that is to say which may be martensitic at ordinary temperatures are:

binary nickel-titanium alloys having a titanium content of between 44 and 47%, silver-cadmium (42%), gold-cadmium (30%), indium-thallium (33%) and copper-tin (9%) alloys, copper-zinc-X alloys, X being one of the following metals: aluminium, silicon, tin, manganese, iron, nickel and gold, copper-zinc-X-Y alloys, X and Y being different ones of the following metals: aluminium, silicon, tin, manganese, iron, nickel and gold.

In the case of copper-zinc-aluminium alloys, experience has shown that there is a preferred range of composition of which the boundaries are the values given in the table below, which indicates the proportions by weight of each of the three components, in the case of six alloys identified as A, B, C, E, F and D which are intended for the production of inner walls for containers intended for use at a mean temperature +20° C.

| | Cu | Zn | Al |
|---|---|---|---|
| A | 68.70 | 28.30 | 3.00 |
| B | 74.75 | 18.00 | 7.25 |
| C | 76.10 | 15.00 | 8.90 |
| D | 77.00 | 15.00 | 8.00 |
| E | 75.70 | 18.00 | 6.30 |
| F | 72.30 | 24.00 | 3.70 |

Figure 2:
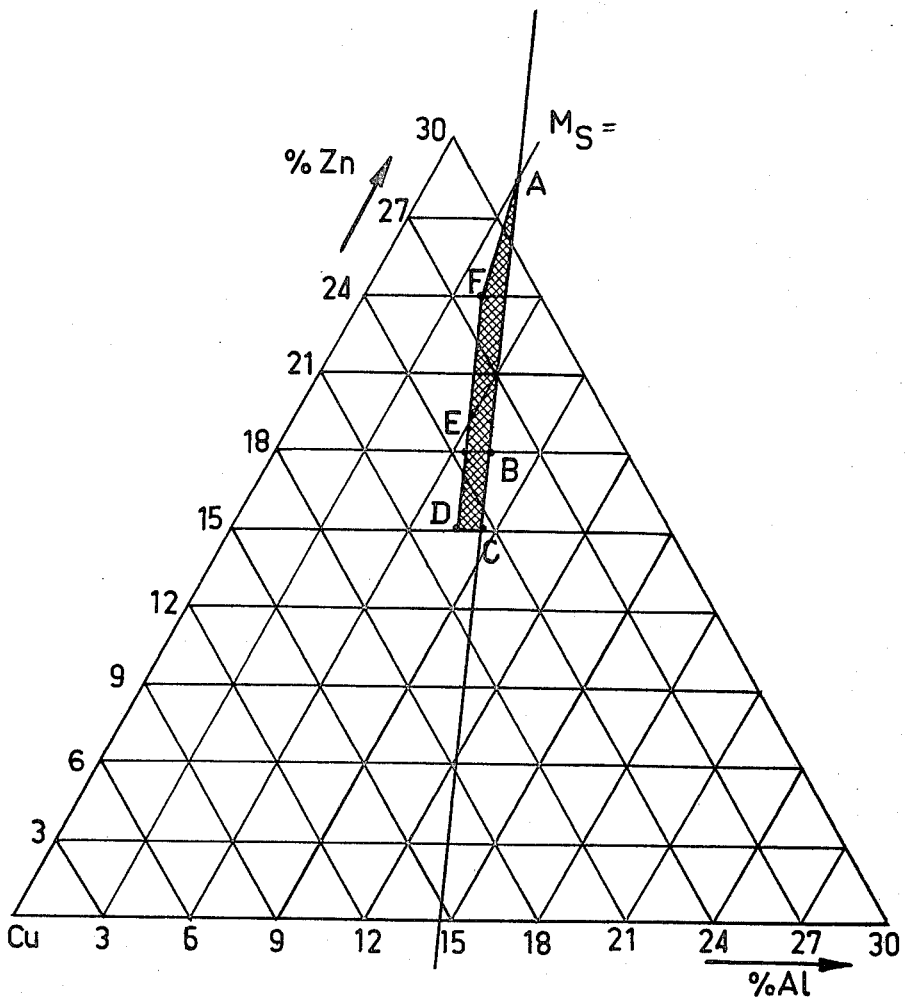
FIG. 2 is a ternary diagram of an alloy of copper, zinc and aluminium showing the preferred composition range for the said alloy, with the percent zinc increasing upwardly from the left corner of the diagram and the percent aluminum increasing horizontally from left to right, the remainder being copper.

These same values are plotted on the ternary diagram of FIG. 2, the preferred range mentioned above being indicated by cross hatching. In the diagram, the straight line ABC represents an $M_s$ value corresponding to the ambient temperature of 20° C. Thus, the alloys whose $M_s$ temperature is less than the ambient temperature, i.e. alloys of the type, are situated to the right of the straight line ABC, while the alloys whose $M_s$ temperature is higher than the ambient temperature, i.e. alloys of the martensitic type, are situated to the left of line ABC.

The following specific alloys have given the best results as regards fatigue strength (more than 100,000 cycles) and resistance to corrosion from the gases stored.

| | | | |
|---|---|---|---|
| Cu : 76.6% | Zn : 15.4% | Al : 8% | ($M_s$ = 73° C.) |
| Cu : 73.4% | Zn : 20.4% | Al : 6.2% | ($M_s$ = 37° C.) |
| Cu : 74.8% | Zn : 18.2% | Al : 7% | ($M_s$ = 38° C.) |
| Cu : 76.2% | Zn : 15.0% | Al : 8.8% | |

Figure 3:
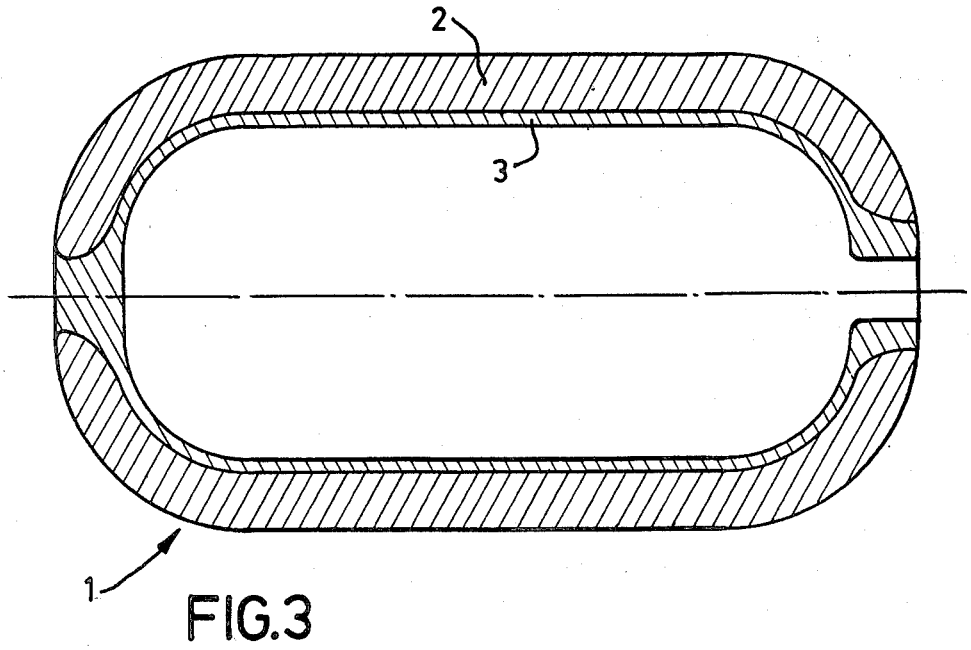
FIG. 3 is a schematic and non-limiting view of a container according to the invention.

In the embodiment shown in FIG. 3, a container 1 according to the invention is broadly in the shape of a circular cylinder which is provided, at its two ends, with two substantially spherical domes.

The inner metal wall of the container may be produced in various ways. In one method, the process starts with a suitable quantity of alloy in the rough state, such as an ingot or a sheet which, after rolling, is of the thickness which the wall is finally intended to have. This is roll-bent and welded to form a cylinder. It is also possible to start with a drawn tube which is brought to the requisite length and thickness by hydrospinning. Two hemispherical end-pieces are then produced by stamping or punching and these are then joined to the cylinder by soldering or bonding.

With this method, the composition of the starting materials (ingot, sheet, tube and hemispherical end-pieces) is already the same as the final composition of the alloy, and the requisite martensitic structure is achieved, after shaping, by a return to the $\beta$ domain followed by rapid cooling.

With another method, the wall may be obtained from an alloy whose composition is different from the final composition required, for example from a copper-zinc, i.e. aluminium free, alloy in cases where it is desired finally to obtain one of the aluminium-zinc-copper alloys described above. In this case the inner wall is first of all shaped as in the previous case and then assembled. The requisite aluminium is then applied by deposition from the gaseous phase or by electrolytic deposition or by any other method which allows the thickness of the deposit to be closely controlled. The wall is then placed in an oven to allow the aluminium to diffuse.

An example will now be given of the production of an inner wall for a container for storing fluid under pressure of the form shown in FIG. 3, that is to say which is formed by a cylindrical body and two hemispherical end-pieces, this inner wall being made from the following alloy:

Cu 73.4%; Zn 20.4%; Al 6.2%.

An ingot of this alloy is first hot-rolled at 800° C. to a thickness of 3 mm and is then cold-rolled, with intervening heating, to a thickness to 0.5 mm for use in making the end-pieces and the body.

The hemispherical end-pieces are produced by stamping and the cylindrical body by roll-bending. The welded joints are made by the T I G process.

To the end-pieces are welded spigots which on the one hand provide a centralising point for the subsequent formation of the outer shell and which on the other hand enable an outlet valve for the fluid to be fixed in position. The inner wall so formed is pressurised by means of water to produce an extension in the longitudinal direction of approximately 2%.

The outer shell is then formed using glass fibre which is coiled around the said wall and impregnated with epoxy resin, the total thickness of this shell being approximately 22 mm.

The container obtained has a capacity of 15 $m^3$ STP, is able to store any gases at a pressure of 300 bars, and has a working life of better than 80,000 cycles.

Many modifications may of course be made to the materials, containers and methods described above without thereby departing from the scope of the present invention as defined by the appended claims.

We claim:

1. In a container for storing fluids at a pressure higher than atmospheric pressure, an outer shell formed by winding fibres of high specific mechanical strength impregnated with thermosetting resin to resist mechanical stresses set up by the fluid under pressure, and an inner wall of metallic material which forms an inner lining for the said shell and which provides a seal, said inner wall being made of a metallic material capable of undergoing a change in crystalline structure of the martensitic type and having a temperature for the appearance of the martensitic phase on cooling which exceeds the usual mean operating temperature of the container and ambient temperature.

2. A container according to claim 1, intended for use at a usual mean temperature of +20° C., wherein said metallic material of said inner wall is an alloy whose said change of crystalline structure of the martensitic type exceeds +20° C. and is less than +50° C.

3. A container according to claim 2, wherein said alloy is selected from the group consisting of:

a nickel-titanium alloy whose titanium content is between 44 and 47%, a silver-cadium alloy, a gold-cadmium alloy, an indium-thallium alloy, a copper-tin alloy, and a quaternary copper-zinc-X-Y alloy in which X and Y are different ones of the following metals: aluminium, silicon, manganese, iron, nickel and gold.

4. A container according to claim 2, wherein said alloy is a copper-zinc-aluminium alloy which lies in an area of the ternary diagram for the said alloy which is bounded by points A, B, C, D, E and F representing the following compositions:

| | Copper | Zinc | Aluminum |
|---|---|---|---|
| A | 68.70 | 28.30 | 3.00 |
| B | 74.75 | 18.00 | 7.25 |
| C | 76.10 | 15.00 | 8.90 |
| D | 77.00 | 15.00 | 8.00 |
| E | 75.70 | 18.00 | 6.30 |
| F | 72.30 | 24.00 | 3.70 |

5. A container according to claim 4 wherein said alloy consists of copper zinc and aluminium within the respective ranges Cu=73.4% to 76.6%

Zn=15.0% to 20.4%

Al=6.2% to 8.8%.

6. A container according to claim 4, wherein said alloy consists of Cu=76.6%: Zn=15.4%: Al=8.0%.

7. A container according to claim 4, wherein said alloy consists of Cu=73.4%: Zn=20.4%: Al=6.2%.

8. A container according to claim 4, wherein said alloy consists of Cu=74.8%: Zn=18.2%: Al=7.0%.

* * * * *